United States Patent [19]

Keller et al.

[11] 4,271,669

[45] Jun. 9, 1981

[54] RECIPROCATING-PISTON ENGINE, ESPECIALLY HOT-GAS ENGINE OR COMPRESSOR

[76] Inventors: Arnulf A. Keller; Norbert A. Keller, both of Bahnhofstrasse 20, Seefeld(Oberbayern), Fed. Rep. of Germany 8031

[21] Appl. No.: 930,341

[22] Filed: Aug. 2, 1978

[30] Foreign Application Priority Data

Aug. 12, 1977 [DE] Fed. Rep. of Germany ..... 2736472

[51] Int. Cl.[3] ..... F02G 1/04

[52] U.S. Cl. ..... 60/517; 60/508; 92/169

[58] Field of Search ..... 92/169, 172; 60/516, 60/517, 518–526, 650, 682, 508, 509, 512, 513, 515

[56] References Cited

U.S. PATENT DOCUMENTS

| | | | |
|---|---|---|---|
| 3,583,155 | 6/1971 | Schuman | 60/520 |
| 3,899,888 | 8/1975 | Schuman | 60/520 X |

*Primary Examiner*—Allen M. Ostrager

*Attorney, Agent, or Firm*—Brady, O'Boyle & Gates

[57] ABSTRACT

The invention concerns reciprocating-piston engines, especially hot-gas engines or compressors, wherein thin plates (2,4) having a height corresponding to the piston stroke are arranged within the working chamber on the piston and on the cylinder head and mesh with one another during the entire piston stroke. The heating or cooling medium is conducted outside of the engagement zone of the plates (6) and heats or cools the plates at the cylinder head by heat conduction (arrows 7), wherein the plates on the piston are likewise heated or cooled by direct action, and the operating medium assumes the temperature of the plates by being exposed to strong turbulence in the narrow gaps. Argon is indicated as an economical operating gas for hot-gas engines.

7 Claims, 4 Drawing Figures

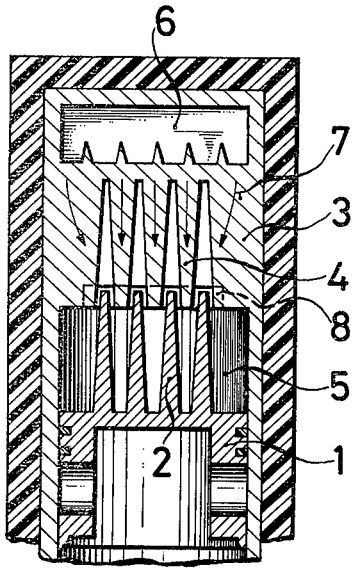
FIG. 1
FIG.3
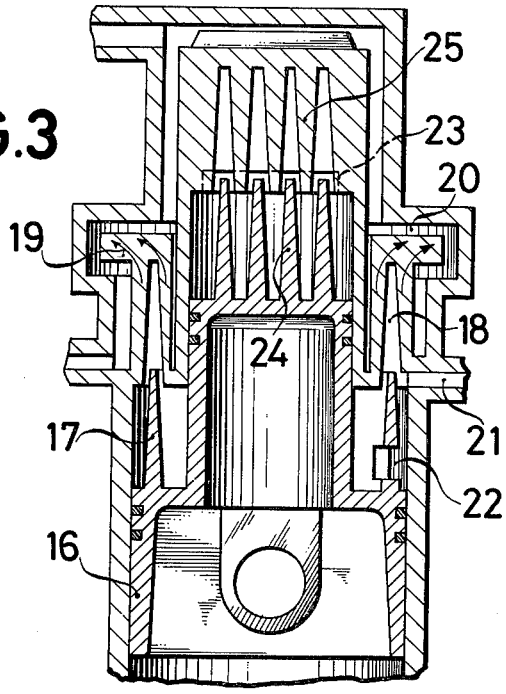
FIG. 2
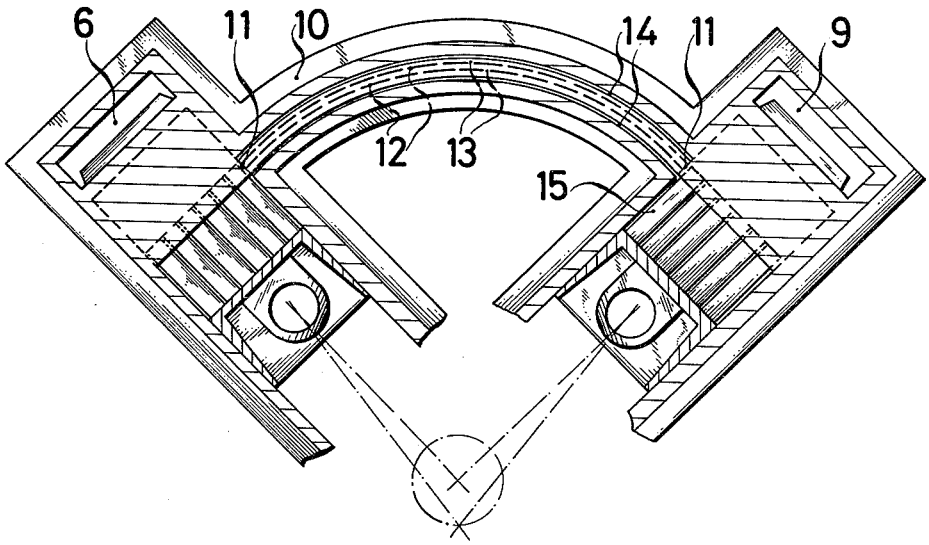

RECIPROCATING-PISTON ENGINE, ESPECIALLY HOT-GAS ENGINE OR COMPRESSOR

The invention relates to a reciprocating-piston engine, especially a hot-gas engine or compressor which is distinguished by intense cooling of the operating medium during compression.

It is known to provide, for heat transfer between the operating medium present in the working chamber and a heating or cooling medium located outside of the working chamber, housing ribs at the cylinder head, which ribs project into the working chamber and cooperate with piston ribs disposed at the piston head. In such reciprocating-piston engines the gas is extensively heated during compression in spite of the external cooling of the engine. This corresponds to a change in condition lying close to an adiabat. Therefore, the temperature rise during compression does not make it possible technically to obtain large pressure increases in an operating cycle. Besides, after each compression step, cooling of the gases must be effected. In this heretofore customary process, the power expended is higher as compared with an isothermal compression and thus the degree of efficiency is lower.

Although broad, low housing ribs arranged at the cylinder head and corresponding piston ribs are conventional, the prior-art ribs enlarge the effective surface only to an insignificant extent and have no appreciable influence on the thermodynamic degree of efficiency. Also, these known ribs enter into the vicinity of the counter surfaces only at the top dead center for a small fraction of the crank revolution and immediately move away again, so that a mutual heat action can hardly be achieved even with this arrangement. Additionally, the heating and cooling medium is conducted in ducts within the housing ribs and in the engagement zone of the piston ribs, which takes up a large amount of space and thus permits the provision of merely a few ribs.

The invention is based on the problem of adapting the mode of operation of reciprocating-piston engines, especially hot-gas engines and compressors, maximally well to an isothermal change in condition, and thus substantially improving the degree of thermal efficiency of such engines.

This problem has been solved in accordance with the invention by fashioning the housing and piston ribs as thin plates which extend into one another without mutual contact during the entire piston stroke, and by conducting the heating or cooling medium outside of the engagement zone of the plates and outside of the plates proper, so that the heat at the cylinder head is transferred in the material by heat conduction and is exchanged directly between the plates at the cylinder head and the plates at the piston. The plates have a length corresponding approximately to the piston stroke and are encompassed even during the piston stroke with a small spacing. In this arrangement, the cooling and heating devices are provided at least in part externally, for example in the extension of the plates mounted to the cylinder head.

The plates of this invention can be profiled, perforated, split in the longitudinal or transverse extension, or designed as rows of wedges, cones, pins, or hollow bodies, whereby an enlarged surface area or more favorable flow conditions can be attained.

In compressors or hot-gas engines having an ordinary piston, it is advantageous to fashion the plates to be planar and have them grouped together more closely toward the center, but the aforementioned plates can also be arranged circularly or spirally with reference to a plane at right angles to the cylinder axis, because in such a case vents for gas exchange or valves can be located more favorably, i.e. with less dead space which is advantageous especially in connection with stepped pistons.

According to the invention, when applied to hot-gas engines, argon gas or argon welding gas is especially advantageous as the operating medium.

By the conductance of the heating or cooling medium outside of the engagement zone of the plates and outside of the plates proper, in accordance with this invention, it is possible to arrange a substantially larger number of plates in close adjacency within the working chamber, whereby a heating and cooling surface area is attained which is a multiple of the area heretofore possible. During the operation of the engine, the edges of the plates are displaced with respect to one another very rapidly, whereby an intense turbulent motion of the medium is obtained due to the comb-like intermeshing of a plurality of plates during the entire piston stroke, with the formation of very narrow gaps. By means of the arrangement according to this invention, heat transfer between the operating medium and the housing and thus the heating and cooling medium is substantially improved. The temperature of the plates attached to the piston adapts itself to that of the plates attached to the cylinder head increasingly with a decreasing mutual lateral spacing of the plates, i.e. adaptation is the better, the narrower the gaps.

Since the heat is directly exchanged between the plates attached to the cylinder head and the plates attached to the piston, the plates mounted at the piston are cooled or heated directly, whereby expenses are considerably reduced. Heretofore, it has been technically impossible to effect some other type of heating of plates attached to the piston.

To ensure high stability and heat conduction, it is advantageous to provide that the plates arranged at the cylinder head and at the piston become thinner towards their free ends.

The plates attached to the piston take part in the stroke movements. Therefore, their mass is to be made as small as possible. These plates are adapted, according to the invention, with respect to their dimensions and their material to the amount of heat transferred during an operating cycle. They can be manufactured, for example, from a light metal of minor thickness.

In connection with its use in hot-gas engines, the invention offers special advantages. This will be explained by way of example, in such an engine having a hot cylinder and a cold cylinder and an exchanger interposed therebetween with a crank displacement of about 90°. In such engines according to the invention, a heater arranged outside of the piston working chamber and also an external cooling unit are no longer necessary. Thereby, the dead space of these parts is eliminated. The heat exchanger with the storage material optionally housed therein can in each case start directly at the piston chamber or terminate at that point, thus avoiding connecting ducts or an additional residual chamber (dead space). Thereby it is possible, if this is desirable, to obtain a significantly higher compression ratio than heretofore customary.

Another advantage provided by a hot-gas engine according to this invention is the fact that the gases displaced from the hot piston chamber are conducted directly into the heat exchanger without again flowing through the hot surface area. This prevents an additional heating of the hot gases immediately prior to the cooling thereof, thus saving an extensively useless heat transport. The same holds true in reverse in case of the cooled cylinder. By the absence of externally disposed heating and cooling surfaces for the medium, it is furthermore possible to make do without connecting ducts, branch lines, or intermediate lines, and the losses incurred thereby.

Monatomic noble gases are recommended for the operation of hot-gas engines, since these gases have thermal properties especially advantageous for this purpose. In general, therefore, helium is employed as the operating medium. However, for economical reasons, argon is to be employed according to this invention. For practical operation, the purity of argon welding gas, which generally is more readily obtainable, is adequate.

In the drawings, the present invention and the mode of operation of engines according to this invention are illustrated and will be explained in greater detail below with reference to examples.

FIG. 1 shows a cross section through the cylinder of an engine according to the invention.

FIG. 2 shows the embodiment of a hot-gas engine.

FIG. 3 shows a cross section through the cylinder of a compressor with a stepped piston.

Figure 4:
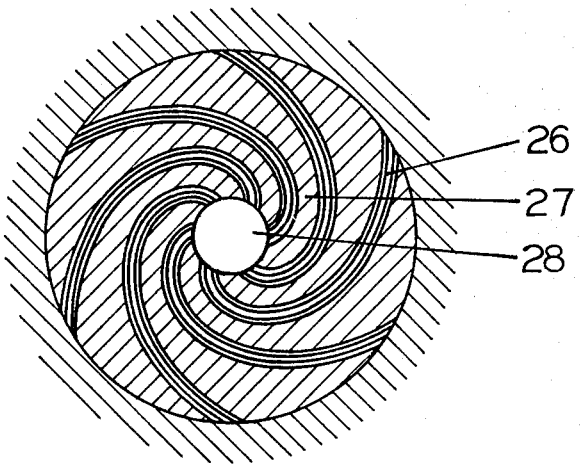
FIG. 4 is a cross-sectional view taken at right angles to the axis of symmentry of a cylinder, and through a modified form of plates on the cylinder and looking downwardly at the cooperating plates on the piston shown in top plan.

Numeral 1 shows the piston in cross section. Numeral 2 denotes the plates extending into the working chamber. Numeral 3 is the cylinder head, and the plates attached thereto and likewise extending into the working chamber are shown at 4. During the piston stroke, the plates 2 move between these plates 4. The operating medium 5 is present in a small layer thickness between the plates 2 and 4, which extend in between one another in close relationship, so that heat exchange occurs between them. At 6, the heating or cooling chamber is indicated which, according to the invention, is not provided in the plates 4 but rather outside in an extension thereof, so that the heat flow to the plates 4 takes place by heat conduction, as indicated by arrows 7. At 8 the vents are arranged through which the gas exchange takes place. FIG. 1 illustrates furthermore that the surface areas 2 and 4 are grouped more closely together toward the center whereby the vents 8 are provided with a more advantageous configuration.

FIG. 2 shows a hot-gas engine, wherein the section through the cylinders is executed rotated by 90° as compared to FIG. 1. In a conventional manner, the hot and cold cylinders are offset by a crank angle of about 90°. At 6, the heating chamber can be seen, while the cooling chamber is at 9 in the cylinder depicted on the right. The heat exchanger 10 is disposed between these chambers and is connected at 11 directly to the stroke chamber of the cylinders. The heat exchanger extends, just as the surfaces 12 for heat storage purposes arranged in this heat exchanger, in the direction of the flowing gases. The surfaces 12 have interruptions 13 with turbulence-producing edges or the like. Numeral 14 denotes internal lining elements of the heat exchanger which can exhibit the same features. The plates attached to the piston are illustrated at 15 by way of example in the form of a number of wedges.

FIG. 3 shows, at 16, the stepped piston of a compressor according to this invention; the plates 17 are disposed in a circular arrangement on the lower part of this piston. The counter surfaces 18 conduct the heat in the direction of the arrows 19 to the cooling medium in chamber 20. At 21, a duct leading to the inlet and outlet valve is shown. At that point, the plates 17 are provided, for example, with a passage opening 22. At the upper step, the duct toward the valves is denoted by 23. The plates 24 and 25, here shown as being of a planar configuration, could also be arranged at this step in a circular shape or in a spiral shape, as shown in FIG. 4 wherein spiral plates 26 on the piston move up between the spiral plates 27 on the cylinder head. In this case, on account of the more favorable flow conditions when using spiral shape plates, it would be preferable to connect the valves in the space shown at 28 at the upper end of the cylinder head.

The type of construction according to this invention and individual features thereof can be utilized not only in conjunction with the illustrated embodiments, but also in other reciprocating-piston engines, especially in other kinds of hot-gas engines or compressors.

What is claimed is:

1. A reciprocating-piston engine comprising, a piston cylinder having a cylinder head (3), a piston (1) connected to reciprocate in said cylinder and having a piston head, said cylinder head and piston head defining a working chamber therebetween in said cylinder adapted to contain an operating medium, housing rib means (4) connected to said cylinder head and extending into the working chamber, cooperating piston rib means (2) connected to said piston head and extending into the working chamber, said housing rib means and said piston rib means comprising thin plates which extend between one another during the entire reciprocating stroke of said piston and without mutual contact during the entire reciprocating stroke of said piston, and said cylinder head having a chamber (6) for heating or cooling medium positioned outside of the housing rib means and outside of the engagement zone of the housing rib means and piston rib means, whereby said housing rib means and piston rib means effect heat transfer between the operating medium in said working chamber and the heating or cooling medium adapted to be present in said chamber (6) in the cylinder head.

2. A reciprocating-piston engine as defined in claim 1, in which said thin plates each comprise a plurality of closely spaced outwardly extending tapered body portions (15).

3. A reciprocating-piston engine as defined in claim 2, in which said tapered body portions comprise wedge portions (15) arranged in rows extending laterally of said cylinder head and said piston head.

4. A reciprocating-piston engine as defined in claim 1, in which the plates are arranged in an intermeshing circular pattern (17, 18) perpendicular to the axis of the cylinder.

5. A reciprocating-piston engine as defined in claim 1, in which the plates are spiral in shape, extending spirally outwardly from the axis of the cylinder on the cylinder head and piston head respectively.

6. A reciprocating-piston engine as defined in claim 4, in which at least one of said circular plates (17, 18) has an aperture (22) through the side wall thereof.

7. A reciprocating-piston engine as defined in claim 1, in which said engine is a hot-gas engine, and the operating medium of said engine being chosen from the group of argon gas and argon welding gas.

* * * * *